US005765529A

United States Patent [19]

Lee

[11] Patent Number: 5,765,529

[45] Date of Patent: Jun. 16, 1998

[54] WIRELESS CONTROL SYSTEM OF A THROTTLE VALVE FOR AUTOMOBILES

[75] Inventor: Yang Soo Lee, Ulsan-si, Rep. of Korea

[73] Assignee: Hyundai Motor Company, Seoul, Rep. of Korea

[21] Appl. No.: 705,232

[22] Filed: Aug. 29, 1996

[30] Foreign Application Priority Data

Aug. 30, 1995 [KR] Rep. of Korea ..... 95-27626

[51] Int. Cl.[6] ..... F02D 11/10

[52] U.S. Cl. ..... 123/399; 251/129.04; 251/129.11

[58] Field of Search ..... 123/339.25, 361, 123/399, 339.19; 251/129.04, 129.11, 129.12

[56] References Cited

U.S. PATENT DOCUMENTS

| | | | |
|---|---|---|---|
| 4,164,120 | 8/1979 | Funk et al. | 123/361 |
| 4,409,940 | 10/1983 | Gaus | 123/361 |
| 4,601,271 | 7/1986 | Ejiri et al. | 123/399 |
| 4,698,535 | 10/1987 | Shiraki et al. | 123/361 |
| 4,721,176 | 1/1988 | Kabasin et al. | 123/399 |
| 4,993,383 | 2/1991 | Wokan et al. | 123/399 |
| 5,193,503 | 3/1993 | Bornmann et al. | 123/399 |
| 5,624,100 | 4/1997 | Bolte et al. | 251/129.11 |

*Primary Examiner*—Andrew M. Dolinar
*Attorney, Agent, or Firm*—Finnegan, Henderson, Farabow, Garrett & Dunner, L.L.P.

[57] ABSTRACT

A wireless control system of a throttle valve for automobiles including a throttle body having a cylindrical path guiding a flow of air; a valve shaft, passing through the center of the throttle body at a right angle to the path of the throttle body; a valve, joined with valve shaft, controlling the amount of air passing through the path and is slightly smaller than and matching the shape of the path; a permanent magnet, disposed at a right angle to one end of the valve shaft, which protrudes outward from the throttle body; an electromagnet fixed on the outside of the throttle body providing the magnetism to the permanent magnet; a return spring, disposed on the other end of the valve shaft which also protrudes out of the throttle body, the return spring providing return rotation force to the valve; and an electronic control unit, connected with a terminal of the electromagnet and which supplies an electrical current thereto when the emission of magnetism by the electromagnet is need.

3 Claims, 5 Drawing Sheets

WIRELESS CONTROL SYSTEM OF A THROTTLE VALVE FOR AUTOMOBILES

BACKGROUND

The present invention relates to a wireless control system of a throttle valve for automobiles, and more particularly, to a wireless control system of a throttle valve for automobiles which decreases its weight and volume by simplifying its structure, reduces damage to parts by preventing the interference of parts during operation, reduces fuel consumption by decreasing the weight of a vehicle body, and improves responsiveness of the throttle valve when a driver depresses an accelerator pedal.

Generally, the throttle valve installed between a surge tank and an air duct allows for the supply of fuel and air needed for engine output as a driver adjusts the opened or closed degree of the throttle valve to control driving speed.

In the prior art as shown in FIG. 7, a throttle valve 104 and an actuator valve 106 are fixed to a throttle body 102. One end of a wire 110, which transmits operational force, is connected to the throttle valve 104 and other end is connected to an accelerator pedal 108 installed in the driver's compartment.

Also, an throttle position sensor 112, connected with an electronic control unit 114 and which senses the position of the throttle valve 104, is disposed at a side of the throttle valve 104, and the idle control actuator valve 106 is operated by a step motor 116, the step motor 116 being connected with the electronic control unit 114.

The electronic control unit 114 is also connected with a wheel speed sensor 118, sensing a driving speed of an automobile, and other such devices.

The following will describe the operation of the above-mentioned conventional art.

First, when stopping the automobile is brought to a stop, the throttle position sensor 112 checks an electrical current speed of the throttle body 102 and transmits this to the electronic control unit(E.C.U.) 114.

Next, the E.C.U 114 outputs an operational instruction to the step motor 116 , and the operation of the step motor 116 opens the idle control actuator valve 106.

When the idle control actuator valve 106 is opened, air supplied through an air duct flows in a surge tank through the idle control actuator valve 106. Simultaneously, the throttle valve 104 is closed because the accelerator pedal 108 is not depressed.

However, when the driver depresses the accelerator pedal 108 the closed throttle valve 104 is opened by the wire 110, and the air supplied from an air duct flows in the surge tank.

As stated, the throttle position sensor 112 checks the electrical current speed passing through the inner part of the throttle body 102 and transmits this to the E.C.U 114, and, the E.C.U 114 transmits an operational order to the step motor 116 which closes the opened idle control actuator valve 106.

Accordingly, air supplied through an air duct flows in a surge tank not through the idle control actuator valve 106 but through the throttle valve 104.

In the conventional means as mentioned above, the throttle valve is operated by a wire connected with an accelerator pedal. As a result, responsiveness is poor because of the separated distance, and because of the complex structure, the durability of each part is reduced and there is interference between the parts.

Another problem of the conventional means is that production costs are increased because of the complex structure and increase in weight. And because of the increased weight, fuel consumption rises.

SUMMARY

The present invention has been made in an effort to solve the above problems.

It is one object of the present invention to improves responsiveness by allowing for an immediate transmission of operation to a throttle valve when a driver operates an accelerator pedal.

It is another object of the present invention to reduce price depreciation of a vehicle by eliminating the problem of interference with other parts, which leads to necessitating the changing of parts, and, at the same time, to decrease the occupying space of parts, resulting in a reduction in the weight of the vehicle by simplifying structure.

To achieve the above object, the present invention comprises a throttle body having a cylindrical path guiding a flow of air; a valve shaft, passing through the center of the throttle body at a right angle to the path of the throttle body; a valve, joined with the valve shaft, controlling the amount of air passing through the path and which is slightly smaller than and matching the shape of the path; a permanent magnet, disposed at a right angle to one of end of the valve shaft, which protrudes outward from the throttle body; an electromagnet, fixed on the outside of the throttle body providing magnetism to the permanent magnet; a return spring, disposed on the other end of the valve shaft protruding out of the throttle body, the return spring providing return rotational force to the valve shaft; and an E.C.U, connected with a terminal of the electromagnet and which supplies an electrical current thereto when emission of magnetism by the electromagnet is needed.

It is another aspect of the present invention to provide a stopper, fixed on the outside of the throttle body, positioned near the valve shaft, and which defines the rotary scope of the permanent magnet.

It is still another aspect of the present invention to provide a luminescent diode and a photo diode connected with the E.C.U. and having a slot plate positioned between thereof. The disk-shaped slot plate having a slot hole drilled along its circumference to allow the passing through of a beam emitted from the luminescent diode. Also, an accelerator pedal is connected to be pivoted with the slot plate at the hinge shaft.

It is still yet another aspect of the present invention to provide a spring holder fixed on the inside of the case and around which the torsion coil spring, that gives restoring force to the accelerator pedal, is inserted.

BRIEF DESCRIPTION OF THE DRAWINGS

Further objects and other advantages of the present invention will become apparent from the following description in conjunction with the attached drawings, in which.

DESCRIPTION

The present invention will now be described with reference to the accompanying drawings.

Figure 1:
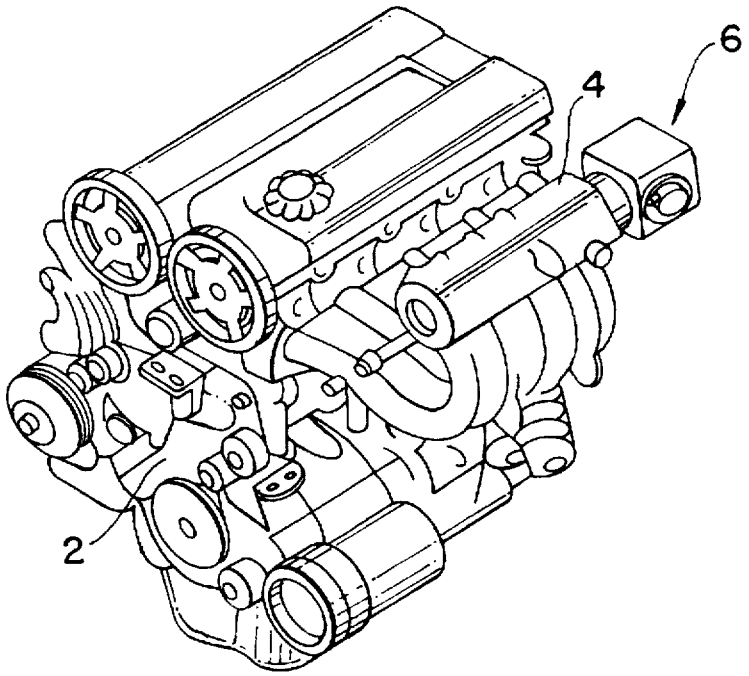
FIG. 1 shows the present invention disposed at a surge tank of a vehicle.

Referring to FIG. 1, a throttle body 6 is joined with a surge tank 4, fixed to an automobile engine 2.

Figure 2:
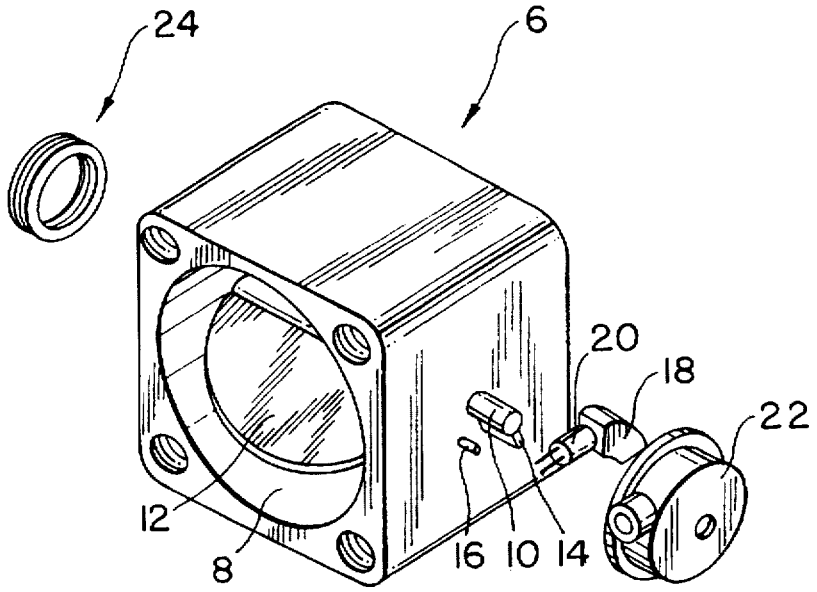
FIG. 2 is a separating perspective view showing a throttle body of the present invention.

As shown in FIG. 2, the throttle body 6 has a cylinder-shaped path 8 guiding the flow of air, and a valve shaft 10 is joined at a right angle to the path 8 such that it can rotate.

Also, a valve 12 controlling the quantity of air following into the valve shaft 10 is fixed thereto, and the valve 12 matches the shape of and is slightly smaller than the inside wall of the path 8.

A permanent magnet 14 is disposed at one end of and at a right angle to valve shaft 10, which passes through both sides of the throttle body 6.

A stopper 16, which limits the rotary scope of the permanent magnet 14, is formed on the outside of the throttle body 6. The stopper 16 positioned such that it prevents the valve 12 from rotating past the point where it is fully open.

Also, an electromagnet 18, producing the same amount of magnetic force as the permanent magnet 14 and having a terminal 20, is fixed at a regular interval from the valve shaft 10. The electromagnet 18 is fixed on the outside of the throttle body 6, positioned where the valve 12 is opened to a degree keeping an idle state.

A cap 22 containing the electromagnet 18 is fixed on the side wall of the throttle body 6 and allows the valve shaft 10 to rotate.

In addition, a return spring 24 providing return rotating power is fixed on the other end of the valve shaft 10. One end of the return spring 24 is fixed on the valve shaft 10 and the other end is fixed on the side wall of the throttle body 6.

Figure 3:
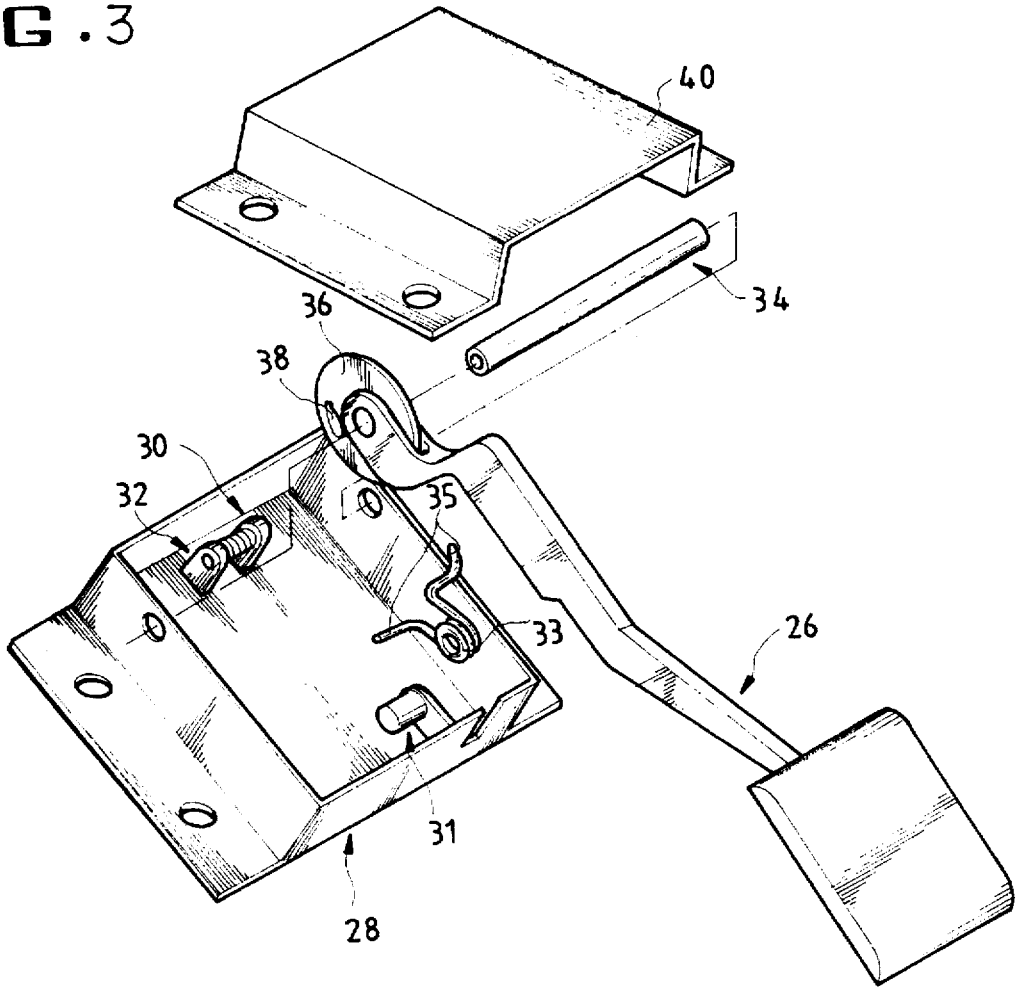
FIG. 3 is a separating perspective view showing an accelerator pedal of the present invention.

FIG. 3 shows a construction of the present invention connected to an accelerator pedal 26.

In FIG. 3, a case 28 is fixed on the floor inside an automobile. Inside the case, a luminescent diode 30 and a photo diode 32 are fixed opposite each other at a predetermined distance.

Also, a hinge shaft 34 passes through both walls of the case 28 and is able to rotate. The vertical hem of the accelerator pedal 26 is joined with the hinge shaft 34.

A disc-shaped slot plate 36 is joined together with the vertical hem of the accelerator pedal 20 that is joined with the hinge shaft 34, and the outside of the disc-shaped slot plate 30 is positioned between the luminescent diode 30 and the photo diode 32.

Figure 4:
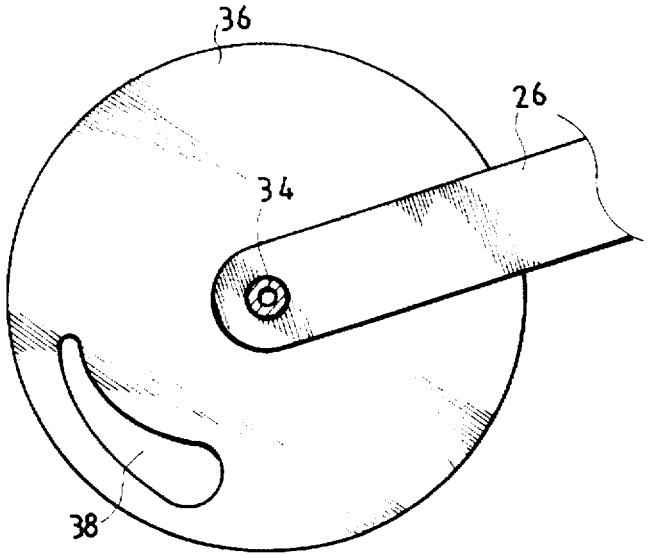
FIG. 4 is a partially sectional view showing an acceleration pedal of the present invention.

As shown in FIG. 4, a slot hole 38 is formed toward the out circumference of the slot plate 36 which allows a beam emitted from the luminescent diode 30 to pass through. The slot 38 formed along the circumference of the slot plate 36 has a width that increasingly enlarges along its length.

Also, a spring holder 31, around which a spring 33 providing elastic force is fixed, is positioned where the accelerator pedal 26 moves up and down. One end portion 35 of the spring 30 contacts the floor of the case 28, and the other end portion 35 of the spring 30 conducts the accelerator pedal 26, providing elastic force to the accelerator pedal 26.

Further, there is a case cover 40 fixed on the upper part of the case 28.

Figure 5:
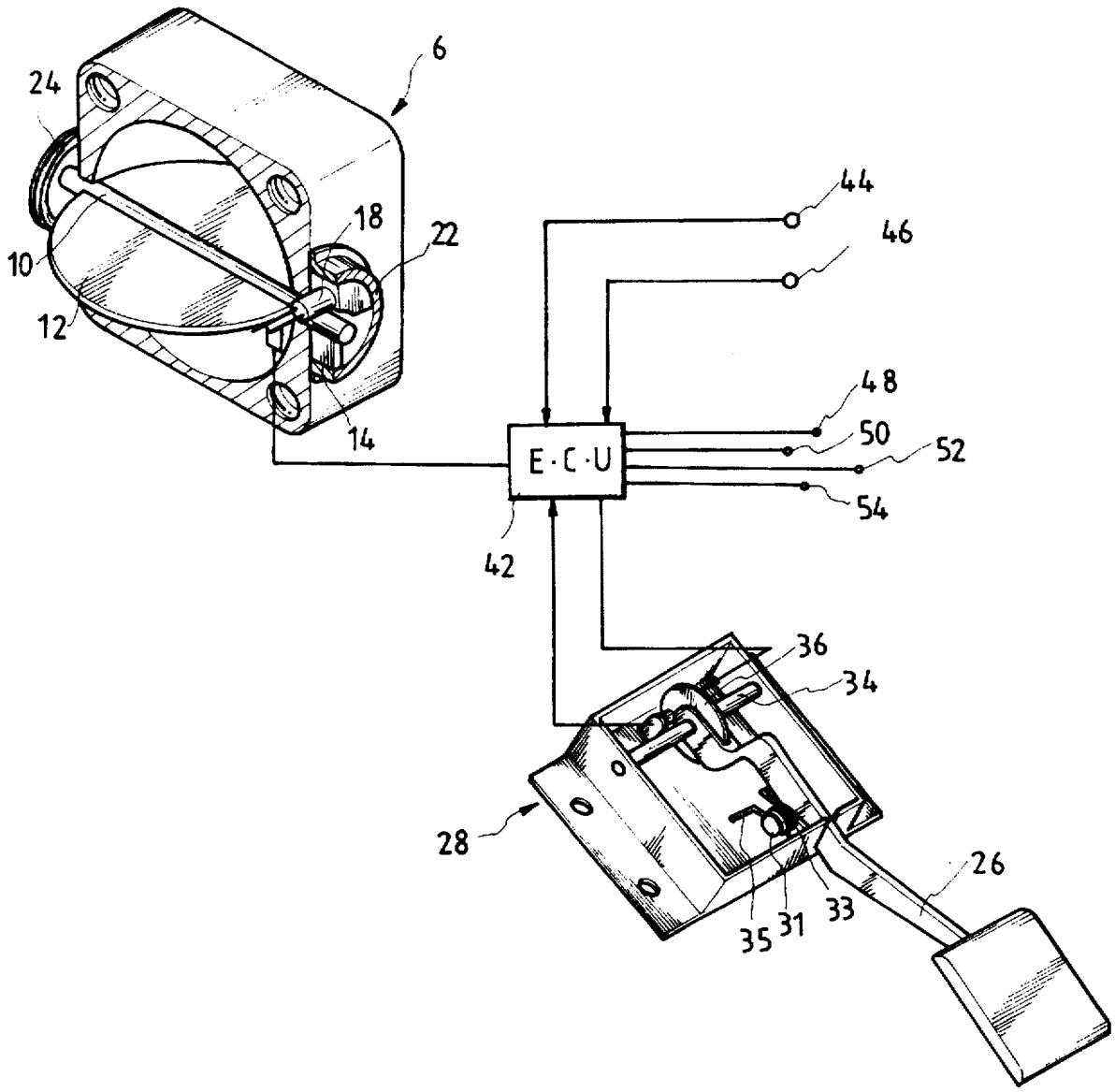
FIG. 5 is a schematic diagram showing an organized state of the present invention.

As shown FIG. 5, the luminescent diode 30 and the photo diode 32 are connected to the E.C.U 42 so that it can receive information about the operational scope of the accelerator pedal 26 send operational instructions.

The E.C.U is connected with an RPM sensor 44, which checks engine RPMs; an ignition switch 46, which makes it so the valve 12 is either maintained in an idle state or according to its on or off state; a first and second wheel speed sensor 48 and 50, respectively disposed on a left front wheel and a right front wheel of an automobile; and a third and a fourth wheel speed sensor 52 and 54, respectively disposed on a left rear wheel and a right rear wheel of an automobile.

Also, the electromagnet 18 is connected to the E.C.U 42 and based on information received, the E.C.U 42 establishes the operational scope of the electromagnet 18.

The operation of the present invention structured as in the above will now be explained.

Figure 6A:
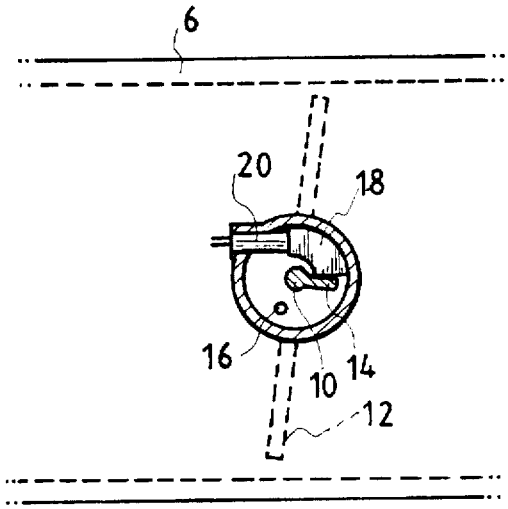
FIGS. 6a, 6b, 6c are an operation state view showing an operation of a throttle valve of the present invention.

First, when the driver turns on the ignition switch 46, the E.C.U. 42 supplies an electric current to the electromagnet 18, which then becomes slightly magnetized. As a result, the permanent magnet 14 becomes distanced from the electromagnet 18 at a fixed angle by the magnetism created by the electromagnet 18 as shown in FIG. 6a.

When the permanent magnet 14 becomes detached from the electromagnet 18, the valve 12 pivots with the rotating valve shaft 10, and the rotation angle of the valve 12 is maintained at an idle state of 3–5 degrees.

If the driver continuously depresses the accelerator pedal 26, the vertical hem of the accelerator pedal 26 pivots on the hinge shaft 34 and rotates together with the slot plate 36. Here, the rotation angle is determined according to the degree of pressure of the accelerator pedal 26.

If the accelerator pedal 26 rotates as in the above, the beam emitted from the luminescent diode 30 reaches the photo diode 32 through the slot hole 38 of the slot plate 36. Here, the amount of beam emitted from the luminescent diode 30 passing through the slot hole 38 is changed depending on the opened degree of the slot hole 30.

At the same time, when the accelerator pedal 26 descends as it is depressed, the support portion 35 of the torsion coil spring 33 receives resistance, and it descends to the floor of the case 28.

In this way, the rotation angle of the accelerator pedal 26 when it is depressed is transmitted to the E.C.U 42 through the photo diode 32.

Also, information of the driving speed from the first, second, third and fourth wheel speed sensors 48, 50, 52 and 54, and information of the rotary speed from the engine speed sensor 44 is transmitted to the E.C.U.

If the E.C.U 42 receives such information as in the above, the E.C.U 42 supplies different amounts of electric current to the electromagnet 18 to open the valve 12 to a safe driving degree. Here, the rotary angle of the permanent magnet 14 depends on the amount of generated magnetism.

Figure 6B:
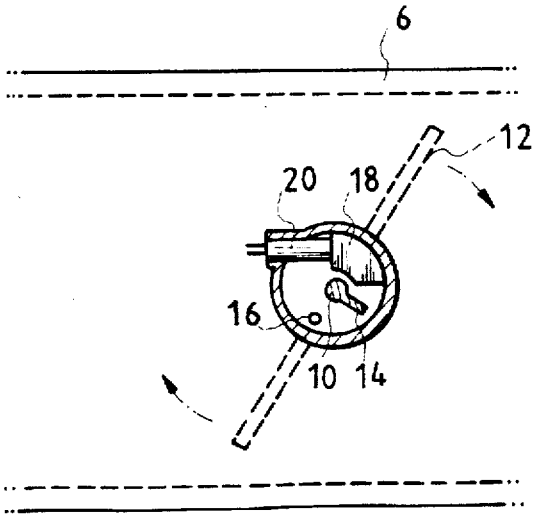

Therefore, as shown FIG. 6b, since the valve shaft 10 is rotated by the movement of the permanent magnet 14 from the magnetism of the electromagnet 18, the valve 12 opens the path 8 to a degree instructed by the E.C.U 42.

At this time, the valve shaft 10 pushes against the return spring 24 and rotates.

Figure 6C:
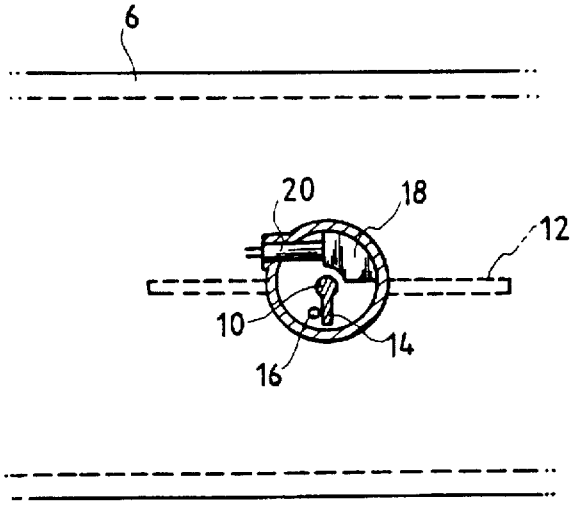
Figure 7:
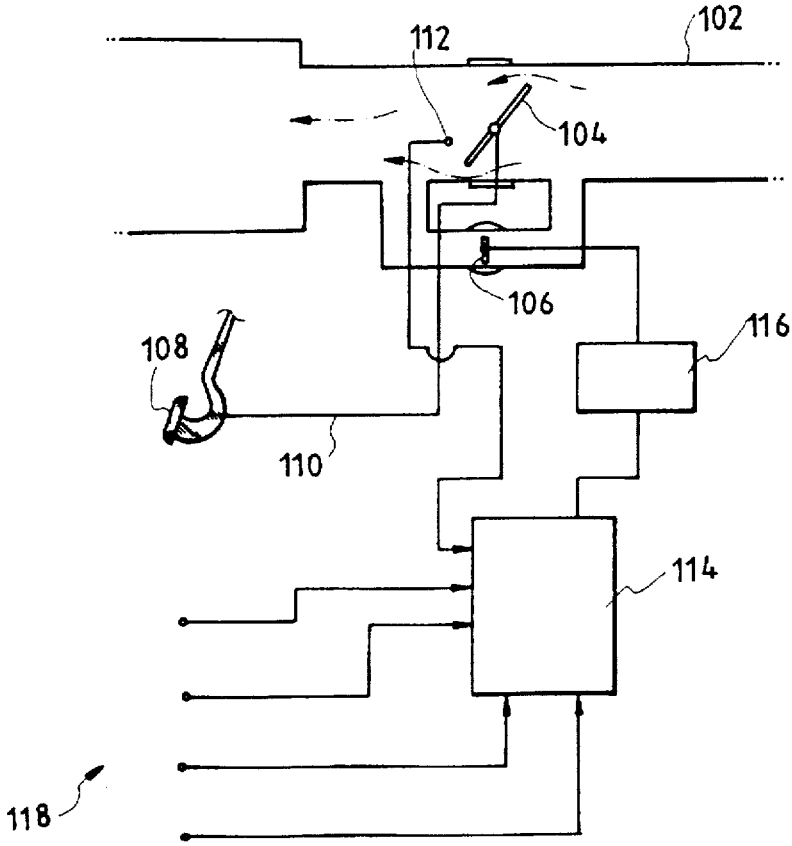
FIG. 7 PRIOR ART
FIG. 7 is a schematic diagram showing a conventional throttle valve.

If the driver depresses the acceleration pedal 26 to its maximum, the amount of magnetism generated by the electromagnet 18 reaches its maximum level as the quantity of the beam emitted from the luminescent diode 30 increases. As a result, as shown FIG. 6c, the valve 12 completely opens the path 8.

Here, when the permanent magnet 14 is separated from the electromagnet 18, this rotational scope is limited by the stopper 16.

However, opposite to that of the above, if the driver releases pressure from the accelerator pedal 26, the accelerator pedal 26 is restored to its initial state by the end portion 35 of the torsion coil spring 33 inserted in the spring holder 31.

At this time, the slot 38 is moved by the rotation of the slot plate 36 and, as a result, the quantity of the beam emitted from the luminescent diode 30 increasingly decreases and eventually cuts off completely in accordance with the narrowing of the slot hole 38.

If the beam emitted from the luminescent diode 30 is cut off completely as in the above, the amount of current supplied by the E.C.U 42 also increasingly diminishes. Next, the valve shaft 10 rotates back by the return spring 24 in accordance with the reduction of magnetism generated by the electromagnet 18.

When the valve 12 is restored, as in the above the path 8 of the throttle body 6 becomes closed, and if the driver does not turn off the ignition switch 46 at this time, the E.C.U continuously transmits a current to the electromagnet 18.

Accordingly, the electromagnet 18 creates magnetism by the continuous supply of current, thus separating from the permanent magnet 14 from itself, maintaining the valve 12 in an idle state of 3 to 5 degrees.

However, if the driver turns off the ignition switch 46, the E.C.U. 42 stops the current supplied to the electromagnet 18 and the valve 12 completely closes the path 8 of the throttle body 6.

Various details of the invention may be changed without departing from its spirit nor its scope. Furthermore, the foregoing description according to the present invention is provided for the purpose of illustration only, and not for the purpose of limiting the invention as defined by the appended claims and their equivalents.

What is claimed is:

1. A wireless control system of a throttle valve for automobiles comprising:

a throttle body having a cylindrical path guiding a flow of air;

a valve shaft passing through the center of the throttle body at a right angle to the path of said throttle body;

a valve, joined with said valve shaft, for controlling the amount of air passing through the path, said valve being slightly smaller than and matching the shape of the path;

a permanent magnet disposed adjacent to one end of said valve shaft, which protrudes outward from the throttle body;

an electromagnet fixed on the outside of the throttle body for providing magnetism to the permanent magnet:

a return spring, disposed on the other opposite end of said valve shaft which also protrudes out of the throttle body, said return spring providing return rotation force to said valve shaft; and an electronic control unit, connected with a terminal of said electromagnet and supplying an electrical current thereto when the emission of magnetism by said electromagnet is needed, and also connected to each terminal of a luminescent diode a and a photo diode, wherein a slot hole is formed on a slot plate between the luminescent diode and photo diode, allowing a beam emitted from the luminescent diode to pass through the slot hole, said slot plate being connected to pivot with a hinge shaft, said hinge shaft and said slot plate being connected to an acceleration pedal so as to rotate in response to movement of the pedal.

2. The wireless control system of claim 1, wherein a case for containing the hinge shaft also contains a spring holder fixed to an inside wall of the case, said spring holder having a spring providing a restoring force to said accelerator pedal.

3. The wireless control system of claim 1, wherein said slot hole formed along the circumference of the slot plate is formed at a fixed angle, and progressively increases in size along its length.

* * * * *